US006496120B1

(12) United States Patent
Devulapalli et al.

(10) Patent No.: US 6,496,120 B1
(45) Date of Patent: Dec. 17, 2002

(54) SYSTEM FOR ON LINE CONTINUOUS SKIDDING DETECTION IN ROLLING MILLS

(75) Inventors: Murty Suryanarayana Devulapalli, Ranchi (IN); Murty Sri Rama Kolluru, Bhilai (IN); Deepak Kumar, Ranchi (IN); Krishnan Shivarama Anantanarayan, Bhilai (IN); Sushil Kumar Sablok, Bhilai (IN); Gopala Krishna Mokkapaty, Ranchi (IN); Mitadru Ray, Bhilai (IN); Sushil Chandra Khan, Ranchi (IN)

(73) Assignee: Steel Authority of India Limited, New Delhi (IN)

( * ) Notice: Subject to any disclaimer, the term of this patent is extended or adjusted under 35 U.S.C. 154(b) by 0 days.

(21) Appl. No.: 09/392,764

(22) Filed: Sep. 7, 1999

(30) Foreign Application Priority Data

Nov. 5, 1998 (IN) ..... 1970/CAL/98

(51) Int. Cl.[7] ..... G08B 21/00

(52) U.S. Cl. ..... 340/679; 72/214; 72/243.4; 164/417

(58) Field of Search ..... 340/679; 72/214, 72/243.4; 164/417

(56) References Cited

U.S. PATENT DOCUMENTS

| | | | | | |
|---|---|---|---|---|---|
| 4,022,048 | A | * | 5/1977 | Korshunov et al. | 72/214 |
| 4,248,073 | A | * | 2/1981 | Verbickas et al. | 72/243 |
| 4,745,556 | A | * | 5/1988 | Turley | 72/11 |
| 4,994,003 | A | * | 2/1991 | Oldfield | 475/72 |
| 5,042,563 | A | * | 8/1991 | Jolivet et al. | 164/476 |
| 5,249,872 | A | * | 10/1993 | Rhodes et al. | 384/574 |
| 5,275,062 | A | * | 1/1994 | Turley | 73/862.474 |
| 5,537,851 | A | * | 7/1996 | Sheu et al. | 72/366.2 |

* cited by examiner

*Primary Examiner*—John A. Tweel
(74) *Attorney, Agent, or Firm*—Ladas & Parry

(57) ABSTRACT

A system for continuous and real-time detection of skidding conditions in a rolling mill in which continuous monitoring of conditions which could lead to skidding and analysis of the monitored conditions is effected and wherein an alarm signal is produced when conditions exceed a threshold and indicate skidding. The system provides for immediate correction of skidding conditions to safeguard the machinery and mill equipment against damage.

26 Claims, 4 Drawing Sheets

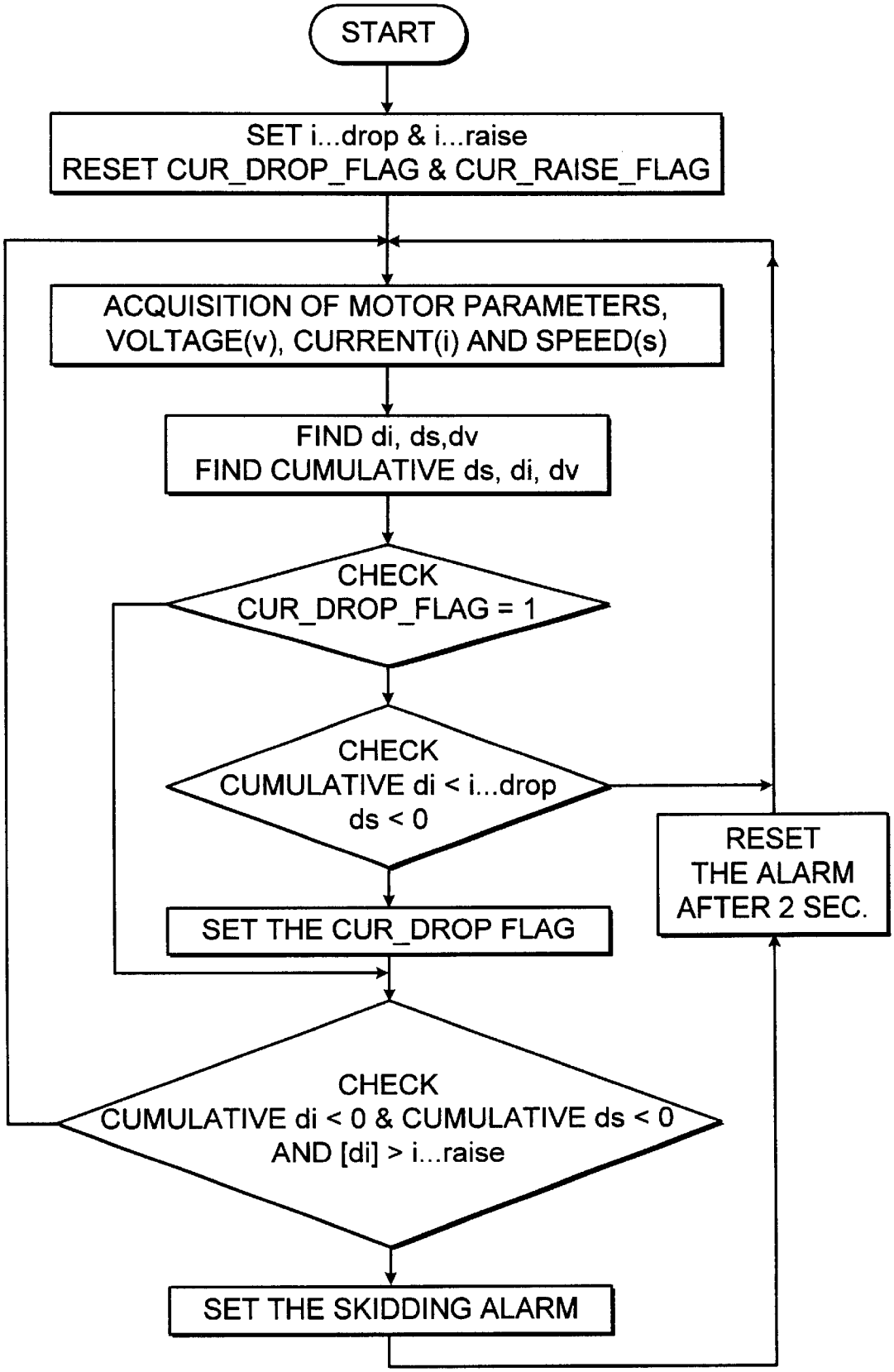
F I G. 1. SKIDDING DETECTION ALGORITHM

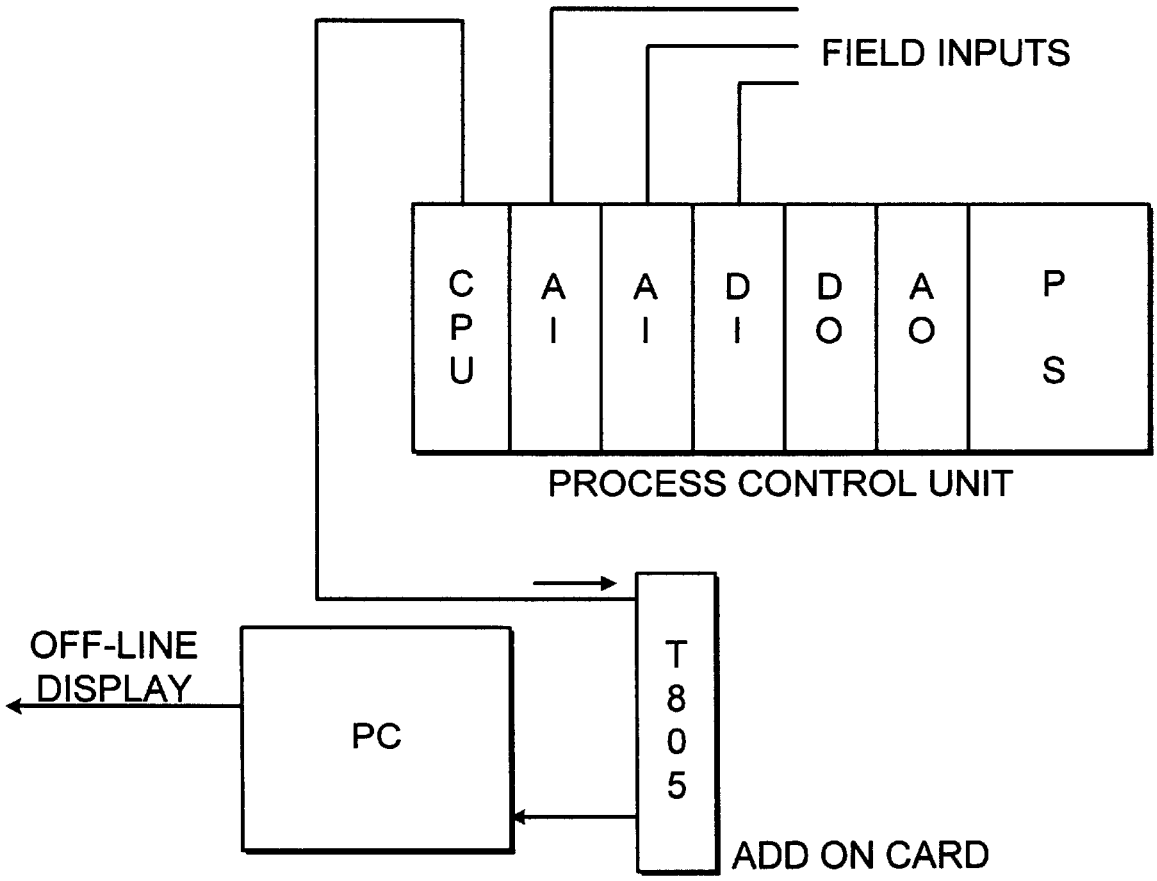
CPU: Central Processing Unit
AI : Analog Input card
DI : Digital Input card
DO: Digital Output card
AO: Analog Output card
PC: Power Supply Unit
NOTE : ADD-ON board is plugged inside PC
F I G. 2. HARDWARE SETUP

PROCESS CONTROL UNIT (PCU)

PCU ACQUIRES DATA STORES IN A CIRCULAR BUFFER

SKIDDING DETECTION LOGIC EXECUTION AND ALARM GENERATION

DATA PACKET CREATION AND ESTABLISHING COMMUNICATION WITH ADD-ON CARD, DATA PACKET TRANSMISSION

ADD ON CARD

RECEIVES THE DATA PACKET FROM PCU STORING IN THE CIRCULAR BUFFER OF ADD-ON CARD AND SETS THE INTERRUPT FOR THE PC TO READ THE QUEUED DATA

PC

INITIALIZATION SCREEN FOR DISPLAY MAKE THE INTERRUPT SERVICE ROUTINE ACTIVE TO READ THE DATA FROM ADD-ON CARD

STORE THE RECEIVED DATA ON HARD DISK AND UPDATE THE SCREEN GRAPHICALLY WITH THE LATEST VALUES

F I G. 3. CONFIGURATION OF TOTAL SYSTEM

SYSTEM FOR ON LINE CONTINUOUS SKIDDING DETECTION IN ROLLING MILLS

FIELD OF THE INVENTION

The present invention relates to a system for online or real-time detection of skidding occurances in rolling mills and in particular to a system for online skidding detection in blooming mills.

BACKGROUND

It is presently known in the art to provide for systems for detection of online skidding in rolling mills wherein the detection is attended on a discrete basis without any possible continuous monitoring and detection of the skidding conditions in the mill. Importantly, it is experienced that such discrete detection of skidding conditions was associated with improper skidding detection failure to effectively detect skidding conditions leading to equipment failure and breakdown of machinery. Importantly, such breakdown in mechanical equipment of the mill such as rollers, spindles, couplings etc. is further associated with loss of rolling hours and consequential loss of productivity of the mill. Added to the above, such conventional skid detection systems do not have any interactive system to generate alarm conditions as and when skidding conditions are noted and are effected to safeguard against any resulting failure/breakdown of the mill machinery involved.

SUMMARY OF THE INVENTION

It is thus the basic objective of the present invention to provide for a system for continuous detection of skidding conditions in rolling mills which would provide for continuous monitoring of skidding conditions, analysis of conditions, generation of alarm signals as and when applicable and further provide for means for immediate rectification of faults to safeguard machinery and mill equipments involved.

Another object of the present invention is to provide for a system for online skidding detection in rolling mills which can be adapted to various types of mills and their capacities as also provide for possible variations in alarm levels depending upon the requirement of the rolling mill in which such system is provided.

Yet another object of the present invention is to provide for a system for online detection of skidding conditions in rolling mills which would provide for continuous monitoring of skidding conditions and will have means to identify causes of skidding occurances.

Yet another object of the present invention is to provide for a system for online skidding detection in rolling mills adapted for fast and continuous acquisition of skidding conditions, analysis of skidding conditions processing and generating alarm/corrective conditions as and when required thereby safeguarding against damage/loss of expensive machinery, rolling hours and productivity.

Thus according to the present invention there is provided a system for online continuous skidding detection in rolling mills comprising:

means for sensing the motor voltage current and speed;

means for sensing the rolling conditions;

means for sensing the pedal position applying the motor voltage;

means for receiving the sensed data concerning voltage current and speed of the motor;

means for receiving the sensed signals on direction of rolling and said pedal position applying the motor voltage;

means for analyzing the data/signal of the motor and rolling conditions and comparing the same with preset standard values on a continuous basis;

means for generating alarm conditions as and when the skidding conditions reach beyond the permissible limit; and means for adjusting the motor voltage depending upon the skidding conditions monitored to avoid possible skidding.

The above disclosed system of the invention constitute a stand alone system to effectuate a continuous monitoring of the skidding conditions in rolling mills and generate alarm/corrective signals as and when occassion arises.

The system of the invention is operative based upon logistics specially developed for determining skid occurances in rolling mills. Such logistics instead of analyzing the data for pre-defined set point i.e. through a set of pre-defined hardware, the input data is continuously analyzed by suitable software capable of performing the defined logistics of skid detection in accordance with the invention. The skid logic details based on which the system is operative as schematically illustrated in greater detail in the accompanying drawing.

BRIEF DESCRIPTION OF THE DRAWING

FIG. 1 is a flow chart showing the skidding detection system according to the inventor.

FIG. 2 is a diagrammatic illustration of the hardware set-up for detecting skidding conditions.

FIG. 3 is a diagrammatic illustration of the process control operation in the system.

DETAILED DESCRIPTION

Figure 4:
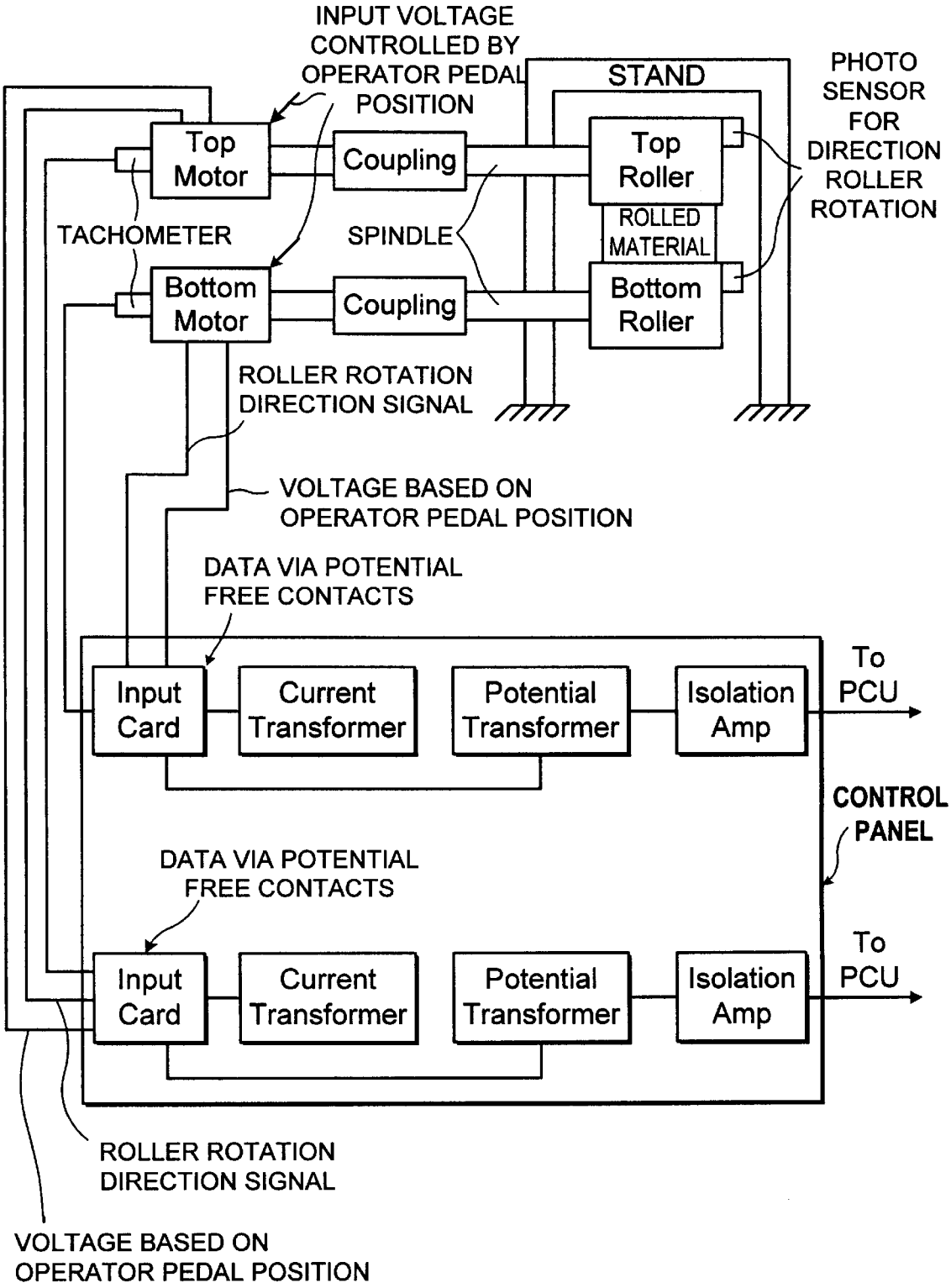
FIG. 4 is a diagrammatic illustration of a rolling mill system.

As shown in FIG. 1, the system of the invention basically utilizes the following sequential logistic analysis of data to determine skid conditions:

i) the system detects any dip in the armature current of the top and bottom roll motors;

ii) If there is any dip of more than say 3 KA followed by a rise of say 2 KA it is registered as a warning of probable skidding. A warning flag is set. No output is generated.

iii) If the above event is repeated within say 1 sec. interval an alarm of skidding is given for the pulpit operators reference. However, if 1 sec. time lapses, the warning flag is reset to normal.

Thus the logic of the skid detection is as follows: The drop in current followed by rise in current (beyond threshold values) within a specified time interval is known as a skid occurrence. For each such occurrence a skid detection alarm is generated. But for confirmation, when two such skid occurrences takes place within a time interval of 500 to 600 milliseconds an alarm (warning) is generated and indicated for the operator's reference. If the same repeats continuously, the corrective action is taken on the drive side, by reducing the operating voltage. The blocks indicate the overall functions which are actually converted into the software.

Importantly, the advantage residing in the above disclosed system of the invention is that the logistics used is applicable/adaptable to any variety of rolling mills. This provides for flexibility and advantages effective use of the system in various types of rolling mills.

Preferably, in the above system of the invention, the means for sensing the motor voltage, current and speed comprise transducer means such as current transducer, potential transformer and analog tachometer mounted on the control panel while the other input signals are obtained of potential free contacts.

In particular, the system is built around a process control unit which constitutes the main module to which various other input/output modules are interfaced through parallel bus configuration.

The means for acquiring data on motor operating conditions comprise an analog input card provided to acquire data for the following parameters of the top and bottom motors of the stand under observation.

a) voltage applied to the motor by the operators;

b) current drawn by the motor; and c) speed at which the motor rotates the roller.

In particular, the said analog input card is operatively connected to the output of said current transducer, potential transformer and analog tachometer through an isolation amplifier.

The means for acquiring input data further comprises a digital input card provided for acquiring the data of the following parameters:

a) photosensor signals for finding the direction of roller; and b) the pedal position of the operator for applying the voltage.

Means for generating alarm signal comprises a digital output card provided to give output for alarm conditions to various places like the pulpit where the operator can take corrective action and a counter for displaying the total number of skid occurances during the shift.

Further output means comprise an analog output card provided for generating output to adjust the voltage applied to the motor in order to maintain the speed whereby skidding possibility can be avoided.

The details of the invention its objects and advantages are explained herein in greater detail with reference to the non-limiting exemplary embodiment of the hardware configuration of the system for determining skidding in rolling mills in accordance with the following figures wherein:

FIG. 2 schematically illustrates the hardware configuration of the system for determining skidding in accordance with the present invention;

FIG. 3 illustrates the flow of operation in the process control unit of the invention.

Reference is now invited to FIGS. 2 and 3 wherein the transputer based hardware of the system of the invention and its working is illustrated. As illustrated in said FIG. 2 the transputer based hardware system comprises of the process control unit which is interfaced with the personal computer via T805 transputer.

The process control unit constitutes a main module and comprises a T805 transputer running on a clock of 25 MHz and having control circuitry, 8 MB RAM/EPROM with a serial link of RS422 with 10 MB per second data transmission capability. The PCU card provided in the process control unit provides for acquiring of the sensed data, storing the data in a circular buffer, executing the skid logic generating the alarm and corrective voltage signals. Also, the PCU card provides for data packet creation and communications with the Add-on card for transmission of data packet.

In particular, the PCU (Process Control Unit) after acquiring the data downloads to the host system (PC) for storing and displaying on the screen. Afer every cycle of data acquisition, the data is converted to a sequence of numbers which are arranged as per the predefined format along with error correcting codes. This sequence of data constitutes the data packet. This packet includes data of motor current, voltage, speed, time and skid alarm etc. This is created by a software module in the PCU. The transputer is thus also involved in transferring this packet to the PC (host system). Such a process control unit constitutes a parallel process unit where all logistic operations with software support are effectuated in parallel. The process control unit is interfaced with other input/output modules through bus configuration.

Importantly, the hardware processor (T805 transputer) provides for the parallel processing which is being used to process the basic data for skid detection and as well as transferring the data from PCU to the PC developmental system for displaying the data in the graphical form.

The system hardware also comprises the Add-on card which provides for receiving data and storing in the circular buffer and transmitting the queued data to the PC.

The personal computer (PC) used in the system of the invention is provided to carry out the functions as clearly defined in FIG. 3. In particular, the PC screen displays the parameters in a graphical form which can be understood easily by anybody. The parameters include motor current speed, voltage, time, ingot number and pass number etc. Through a menu either the top or bottom motor can be selected. The nature of the data in digital form is transmitted through the data packet which is explained earlier. The PC interface card constituting a transputer is linked to the PCU through RS422 channel. The data is initially stored in the memory of the interface. The interface card generates an interrupt in the PC hardware. The software in the memory of the PC will acknowledge the interrupt and receive the data and stores it in the memory of the PC. During this time, the front end program which is running is inhibited. Unless the complete packet data is received the screen can not be updated. After completion of screen updating, the next set of data is processed by the PC for next updating. The interrupt routine has to receive only one byte at a time and is stored in the queue memory and goes back to service the main program of the PC.

The software required for data analysis and detection of the skid occurrence is preferably is preferably downloaded into the process control unit (PCU) through a serial link from the personal computer (PC). An interface card in the PC is provided for this purpose which can also be based on the transputer processor. The PC and the interface card unit together constitute the development system. The software is finally preferably placed in the EPROMs and are plugged onto the process control unit (PCU). The PCU thus constitutes the final hardware along with the software which can be a stand alone system. This can operate continuously without any external interface.

Optionally and advantageously the PC based development system can provide Management Information Service (MIS) such as number or skid occurrences and the conditions prevailing at that time. Moreover, in the system the data can be stored continuously in the hard disk at regular intervals. In particular, the hardware configuration given in the scheme is final. The PC based developmental system is detachable from the PCU system, i.e., PCU is a stand along system. The PC based developmental system will enable logging the data collected by PCU. The data is processed to generate the reports for management information service (MIS). The report can consist of the total number of skids, time of each skid occurrence, the values of parameters (like current, speed and voltage). There is an off-line software module which can display the data of any particular ingot in a graphical way to assess the operation.

We claim:

1. A system for online continuous skidding detection in rolling mills having:

means for sensing motor voltage, current and speed;

means for sensing rolling conditions; and means for sensing a pedal position applying the motor voltage;

said system comprising:

means for receiving sensed data concerning voltage, current and speed of the motor;

means for receiving sensed signals regarding direction of rolling and said pedal position applying the motor voltage;

means for analyzing the data and signals of the motor and rolling conditions and comparing the same with present standard values on a continuous basis;

means for generating alarm conditions when the skidding conditions exceed a permissible limit; and means for adjusting the motor voltage depending upon the skidding conditions monitored to avoid possible skidding.

2. A system for online continuos skidding detection in rolling mills as claimed in claim 1, wherein said means for sensing the motor voltage, current and speed comprises transducer means mounted on a control panel while the other input signals are obtained from potential free contacts.

3. A system for online continuous skidding detection in rolling mills as claimed in claim 2 wherein said transducer means comprises current transducer, potential transformer and analog tachometer.

4. A system for online continuous skidding detection in rolling mills as claimed in claim 1 wherein said means for sensing the motor voltage, current and speed and the other input signal means comprise potential free contacts.

5. A system for online continuous skidding detection in rolling mills as claimed in claim 1 wherein said means for receiving the sensed signals, means for analyzing the sensed data and signals with preset standard valves, means for generating alarm signs when occasion arises and means for adjusting the motor voltage are provided in a process control unit.

6. A system for online continuous skidding detection in rolling mills as claimed in claim 5 wherein said process control unit constitutes a main module to which various other input/output modules are interfaced through a parallel bus configuration.

7. A system for online continuous skidding detection in rolling mills as claimed in claim 1, wherein said means for receiving data on motor operating conditions comprises an analog input card provided to acquire data for the following parameters of top and bottom motors of a stand under observation:

a) voltage applied to the motor by the operators;

b) current drawn by the motor; and c) speed at which the motor rotates the roller.

8. A system for online continuous skidding detection in rolling mills as claimed in claim 7 wherein said analog input card is operatively connected to the output of said current transducer, potential transformer and analog tachometer through an isolation amplifier card.

9. A system for online continuous skidding detection in rolling mills as claimed in claim 1 wherein said means for receiving input data further comprises a digital input card provided for acquiring the data of the following parameters:

a) photosensor signals for finding the direction of a roller; and b) the pedal position of the operator for applying the voltage.

10. A system for online continuous skidding detection in rolling mills as claimed in claim 1 wherein said means for generating alarm signal comprises a digital output card provided to generate alarm signals at desired locations for corrective action and having means for displaying the total number of skid occurrences during a desired period of time.

11. A system for online continuous skidding detection in rolling mills as claimed in claim 1 comprising an analog output means provided for generating output to adjust the voltage applied to the motor in order to maintain a desired speed whereby skidding could be avoided.

12. A system for online continuous skidding detection in rolling mills as claimed in claim 1 wherein the system is transputer based.

13. A system for online continuous skidding detection in rolling mills as claimed in claim 5 wherein said process control unit is operatively connected to a host system for storing and displaying data acquired from said process control unit.

14. A system for online continuous skidding detection in rolling mills as claimed in claim 13 wherein said host system comprises a personal computer operatively connected to said process control unit via a transputer.

15. A system for online continuous skidding detection in rolling mills as claimed in claim 5 wherein said process control unit comprises a PCU card for acquiring the sensed data, storing the data in a circular buffer and executing the skid logic for generating the alarm signal and corrective voltage signals.

16. A system for online continuous skidding detection in rolling mills as claimed in claim 15 wherein said PCU card provides for data packet creation and communications with the Add-on card for transmission of data packet to said host system.

17. A system for online continuous skidding detection in rolling mills as claimed in claim 5 wherein said process control unit constitutes a parallel process unit wherein all logistic operations with software support are effectuated such that all software modules are computed in parallel.

18. A system for online continuous skidding detection in rolling mills as claimed in claim 5 wherein said process control unit is interfaced with other input/output modules through bus configuration.

19. A system for online continuous skidding detection in rolling mills as claimed in claim 12 wherein the transputer based hardware processor provides for the parallel processing which is adapted to process the basic data for skid detection and transferring the data from the process control unit to the personal computer for displaying the data in the graphical form.

20. A system for online continuous skidding detection in rolling mills as claimed in claim 13 comprising an add-on card which provides for receiving data and storing in the circular buffer and transmitting the queued data to the host system.

21. A system for online continuous skidding detection in rolling mills as claimed in claim 13 wherein said host system comprises a personal computer which displays the parameters in a graphical form.

22. A system for online continuous skidding detection in rolling mills as claimed in claim 12 wherein a PC interface card constituting a transputer is operatively linked to PCU and said interface and constitutes means for storing the data in the memory and generate interrupt in the PC hardware.

23. A system for online continuous skidding detection in rolling mills as claimed in claim 12 wherein the process control unit comprises software based skid logic execution means.

24. A system for online continuous skidding detection in rolling mills as claimed in claim 22 wherein said PC and the interface card unit together constitute a development system.

25. A system for online continuous skidding detection in rolling mills as claimed in claim 24 wherein said developmental system is detachable from the PCU system and comprise means for login the data collected by PCU, means to process the data to generate the reports for various applications such as hereindescribed.

26. A system for online continuous skidding detection in rolling mills as claimed in claim 1 comprising a module for display of data of any particular ingot in a graphical way to assess the operation.

* * * * *